US011585534B2

(12) United States Patent
Stoltzfus et al.

(10) Patent No.: US 11,585,534 B2
(45) Date of Patent: Feb. 21, 2023

(54) FIRE PIT CONVERSION RING AND METHOD

(71) Applicant: Breeo, LLC, Kinzers, PA (US)

(72) Inventors: Amos A. Stoltzfus, Gordonville, PA (US); Jonathan C. Miller, New Providence, PA (US); Omar G. Stoltzfus, New Holland, PA (US)

(73) Assignee: Breeo, LLC, Kinzers, PA (US)

( * ) Notice: Subject to any disclaimer, the term of this patent is extended or adjusted under 35 U.S.C. 154(b) by 0 days.

(21) Appl. No.: 17/333,750

(22) Filed: May 28, 2021

(65) Prior Publication Data

US 2022/0349582 A1 Nov. 3, 2022

Related U.S. Application Data

(60) Provisional application No. 63/182,474, filed on Apr. 30, 2021.

(51) Int. Cl.
*F24B 3/00* (2006.01)

(52) U.S. Cl.
CPC ..... *F24B 3/00* (2013.01)

(58) Field of Classification Search
None
See application file for complete search history.

(56) References Cited

U.S. PATENT DOCUMENTS

D253,931 S 1/1980 DeVischer et al.
D262,427 S 12/1981 Boston et al.
D286,002 S 10/1986 Brix
D361,467 S 8/1995 Kabayama
D374,072 S 9/1996 Coble
D389,009 S 1/1998 Baykal
D432,356 S 10/2000 Hoff et al.
6,289,795 B1 * 9/2001 McLemore ..... A47J 37/0786 126/25 R
D449,490 S 10/2001 Frederick
D466,597 S 12/2002 Carr
D486,356 S 2/2004 Hoff et al.
D542,091 S 5/2007 Hoff et al.
D545,124 S 6/2007 Hawkins et al.
D590,201 S 4/2009 Zagar
D602,148 S 10/2009 DeFouw et al.
D679,791 S 4/2013 Lowsky
(Continued)

OTHER PUBLICATIONS

Breeo, How to Install Your Breeo Insert Ring, Youtube, Mar. 23, 2021, accessed Apr. 15, 2021, from https://www.youtube.com/watch?v=dKXx6-siRR0&t=6s.

(Continued)

*Primary Examiner* — Jason Lau
(74) *Attorney, Agent, or Firm* — Fred Zollinger

(57) ABSTRACT

A conversion ring for a portable fire pit allows the portable fire pit to be used within a block fire pit ring. If desired, the owner can remove the fire pit from the conversion ring and the block ring and use it in different locations. The conversion ring and the fire pit can lock together to limit rotational movement after installation. The conversion ring includes locking fingers that cooperate with elements of the fire pit. In one configuration, the locking fingers of the conversion ring cooperate with the legs of the fire pit when the fire pit is installed through the conversion ring.

9 Claims, 9 Drawing Sheets

(56) References Cited

U.S. PATENT DOCUMENTS

| | | | | |
|---|---|---|---|---|
| D724,714 | S | 3/2015 | Benson et al. | |
| 8,991,382 | B1 | 3/2015 | Mau | |
| D734,436 | S | 7/2015 | Raether | |
| D734,975 | S | 7/2015 | Troyer | |
| D742,490 | S | 11/2015 | Jepson | |
| D774,172 | S | 12/2016 | Zemel et al. | |
| D777,307 | S | 1/2017 | Rocha | |
| 10,222,092 | B1 * | 3/2019 | Traeger | F24B 3/00 |
| D858,729 | S | 9/2019 | Scott | |
| D868,230 | S | 11/2019 | Nitschmann | |
| 10,888,195 | B1 | 1/2021 | Norris et al. | |
| D914,172 | S | 3/2021 | Stoltzfus | |
| D927,659 | S | 8/2021 | Stoltzfus | |
| 2006/0236996 | A1 | 10/2006 | Mosher, II et al. | |
| 2011/0073098 | A1 | 3/2011 | Chang | |
| 2012/0087128 | A1 | 4/2012 | Zakula et al. | |
| 2013/0306184 | A1 | 11/2013 | Prischak | |
| 2016/0166109 | A1 * | 6/2016 | Banal | A47B 13/081 108/50.13 |
| 2019/0159630 | A1 | 5/2019 | Salum | |
| 2019/0277520 | A1 | 9/2019 | Zakula et al. | |
| 2020/0096199 | A1 | 3/2020 | Harrington et al. | |
| 2021/0018180 | A1 | 1/2021 | Jan et al. | |
| 2021/0045578 | A1 | 2/2021 | Stoltzfus | |
| 2021/0048188 | A1 | 2/2021 | Harrington et al. | |
| 2021/0156565 | A1 | 5/2021 | Skillman | |
| 2021/0404663 | A1 | 12/2021 | Strange | |

OTHER PUBLICATIONS

Breeo, admitted prior art, Zentro Fire Pit Insert, Smoke-Reducing, Heavy Duty, and American Made. 24" Zentro Fire Pil.

Breeo, X19 Smokeless Fire Pit Insert Bundle, screenshot from https://breeo.co/collections/x-series/products/x-series-19-insert-ring-fire-pit, accessed Apr. 15, 2021.

U.S. Pat. No. 821,933, May 29, 1906, Elliott.

U.S. Pat. No. 980,919, Jan. 10, 1911, Buckley.

Nov. 26, 2021 Office Action in U.S. Appl. No. 29/781,771, filed Apr. 30, 2021.

Arteflame Replacement BBQ Grill Griddle Grate, Aug. 9, 2018, Amazon, site visited Nov. 15, 2021: https:/www.amazon.com/dp/B06XSB48CH/ (Year: 2018).

Ofyr Grill Review, Apr. 4, 2019, YouTube, site visited Nov. 15, 2021 : https://www.youtube.com/watch?v=81gvBCOKI6M (Year: 2019).

* cited by examiner

FIRE PIT CONVERSION RING AND METHOD

CROSS REFERENCE TO RELATED APPLICATIONS

This application claims the benefit of U.S. Provisional Patent application No. 63/182,474 filed Apr. 30, 2021; the disclosures of which are incorporated herein by reference.

BACKGROUND OF THE DISCLOSURE

1. Technical Field

The disclosure relates to outdoor fire pits that can be used as stand-alone, portable devices and as built-in fire pit inserts within block fire pit rings. The disclosure provides a conversion ring that is used to mount the stand-alone fire pit within a block fire pit ring.

2. Background Information

Double-walled fire pits are known in the art for substantially reducing smoke when properly fueled. A variety of double-walled stand-alone fire pits are known. Some people have desired the benefits of the double-walled fire pit while being able to use an existing block fire pit that already exists on their property. One accommodation for these people has been provided as the ZENTRO® fire pit insert sold by Breeo, LLC. The ZENTRO® fire pit insert included the double-walled air inlet construction and an upper rim that supported the insert in a block fire pit ring. Expansion rings were also provided to allow the insert to be used with block fire pit rings that were larger than the insert's upper rim. Although these inserts were effective, they could not operate independently of block fire pit ring.

SUMMARY OF THE DISCLOSURE

The disclosure provides a conversion ring for a portable fire pit that can be used on its own in different locations. The conversion ring allows the portable fire pit to be used within a block fire pit ring. If desired, the owner can remove the fire pit from the block fire pit ring and use the fire pit in different locations without the block fire pit ring.

The disclosure provides a method for converting a portable, stand-alone fire pit into a fire pit insert used with a block fire pit ring.

The disclosure also provides configurations of the conversion ring and fire pit that engage together to limit relative rotational movement after installation. In one configuration, the conversion ring includes locking fingers that cooperate with elements of the fire pit to limit relative rotation. In one configuration, the locking fingers of the conversion ring cooperate with the legs of the fire pit when the fire pit is installed through the conversion ring. Another configuration provides a locking finger on the conversion ring that slides into a recess defined by the fire pit to limit the relative rotation.

The individual features may be combined in different combinations than specifically described below to form different configurations of the device of the disclosure. The preceding non-limiting aspects of the disclosure, as well as others, are more particularly described below. A more complete understanding of the devices, assemblies, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 8:
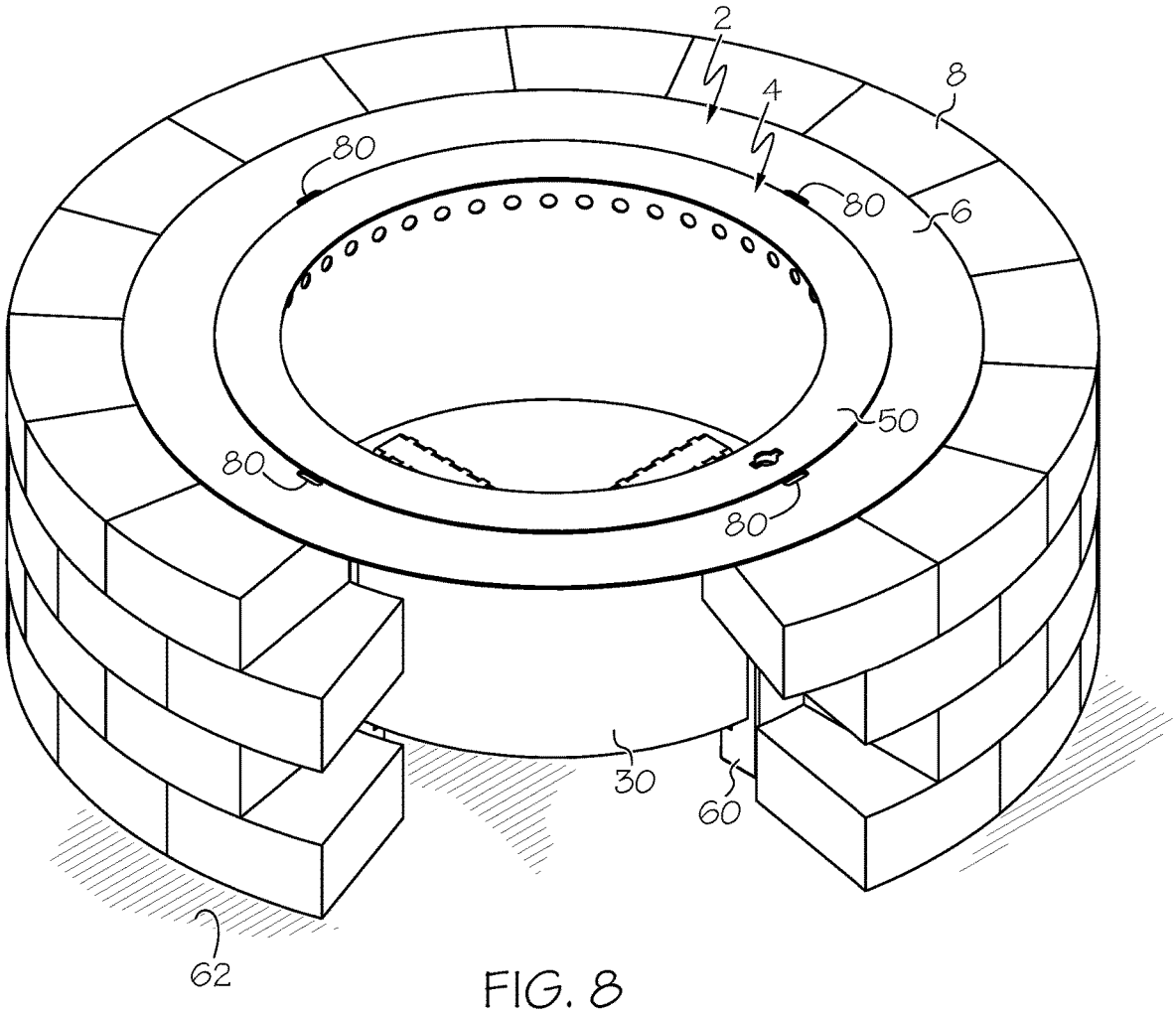
FIG. 8 is a perspective view of the fire pit and conversion ring installed in a block fire pit ring with a portion removed.
Figure 9:
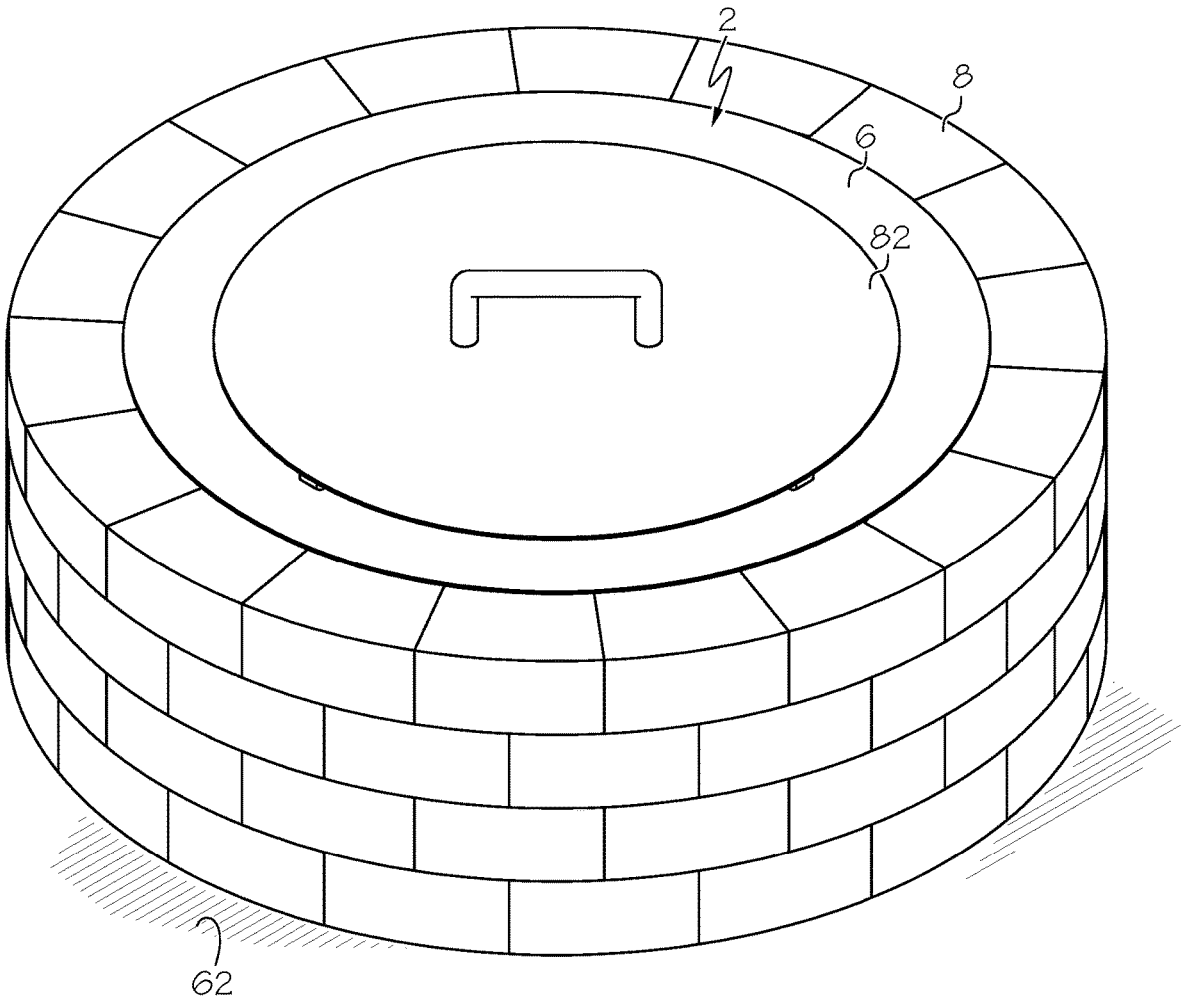
FIG. 9 is a perspective view of the fire pit and conversion ring installed in a block fire pit with a cover installed.

An exemplary configuration of the combination 2 of a portable fire pit 4 installed in a conversion ring 6 is depicted in FIGS. 1-6. This combination 2 is installed in a block fire pit ring 8 as shown in FIGS. 8 and 9. Portable fire pit 4 can function both independent of and in combination with block fire pit ring 8 which provides versatility to the owner. Combination 2 allows stand-alone fire pit 4 to be used in a tradition block ring 8 as desired by the owner. Portable fire pit 4 is slid through conversion ring 6 when fire pit 4 is installed into block fire pit ring 8. Conversion ring 6 is located between portable fire pit 4 and block fire pit ring 8 when in use. The exemplary configuration of fire pit 4 is circular, but conversion ring 6 can be configured for use with rectangular or oval fire pits 4. In the exemplary configuration, conversion ring 6 interlocks with portable fire pit 4 to prevent relative rotation between the two when installed. Particularly, rotation is prevented in an imaginary reference plane that contains conversion ring 6 such as the plane of the paper of FIGS. 4 and 5.

Portable fire pit 4 has a main body 20 that defines a fire box 22 where the fuel is burned when portable fire pit 4 is used. Main body 20 is defined by at least the inner portion of a sidewall 24 and a bottom wall 26. In this configuration, sidewall 24 has a double wall construction with an inner sidewall 28 and an outer sidewall 30 that cooperate to define an airflow passage with an air inlet 32 at its lower end. Air outlets 34 are disposed about an upper portion of inner sidewall 28. An air inlet assembly 40 is carried by bottom wall 26 and includes a plurality air inlet openings 42 defined by bottom wall 26. The double wall construction and the particular air inlet assembly are optional. Other portable fire pit 4 constructions can be used with conversion ring 6.

Portable fire pit 4 includes a flange 50 that extends at least outwardly from the top end of sidewall 24. In the exemplary configuration, flange 50 also extends inward over a portion of fire box 22. In this application, the inward direction means toward the center of the fire box when viewed from above and the outward direction means away from the center of the fire box when viewed from above. The up direction means from bottom wall 26 toward flange 50 and the down direction means from flange 50 toward bottom wall 26. Conversion ring 6 is sized to fit around sidewall 24 with a portion under flange 50. In the circular configuration, the outer diameter of flange 50 is greater than the inner diameter of conversion ring 6 but smaller than the outer diameter of conversion ring 6. The outer diameter of conversion ring 6 is greater than the diameter of the inner edge of the block fire pit ring so that conversion ring 6 rests on top of blocks as shown in FIG. 8. Conversion ring 6 fills the space between portable fire pit 4 and the blocks of block fire pit ring 8. In some configurations, conversion ring 6 supports portable fire pit 4 but when block fire pit ring 8 is sized to match portable fire pit 4, the legs 60 of portable fire pit 4 support portable fire pit 4 within block fire pit ring 8.

In the exemplary configuration, conversion ring 6 is a thin, flat ring-shaped member with an outer edge and an inner edge. When installed, the inner edge is spaced outwardly from sidewall 24. Conversion ring 6 does not extend down and under portable fire pit 4.

Figure 1:
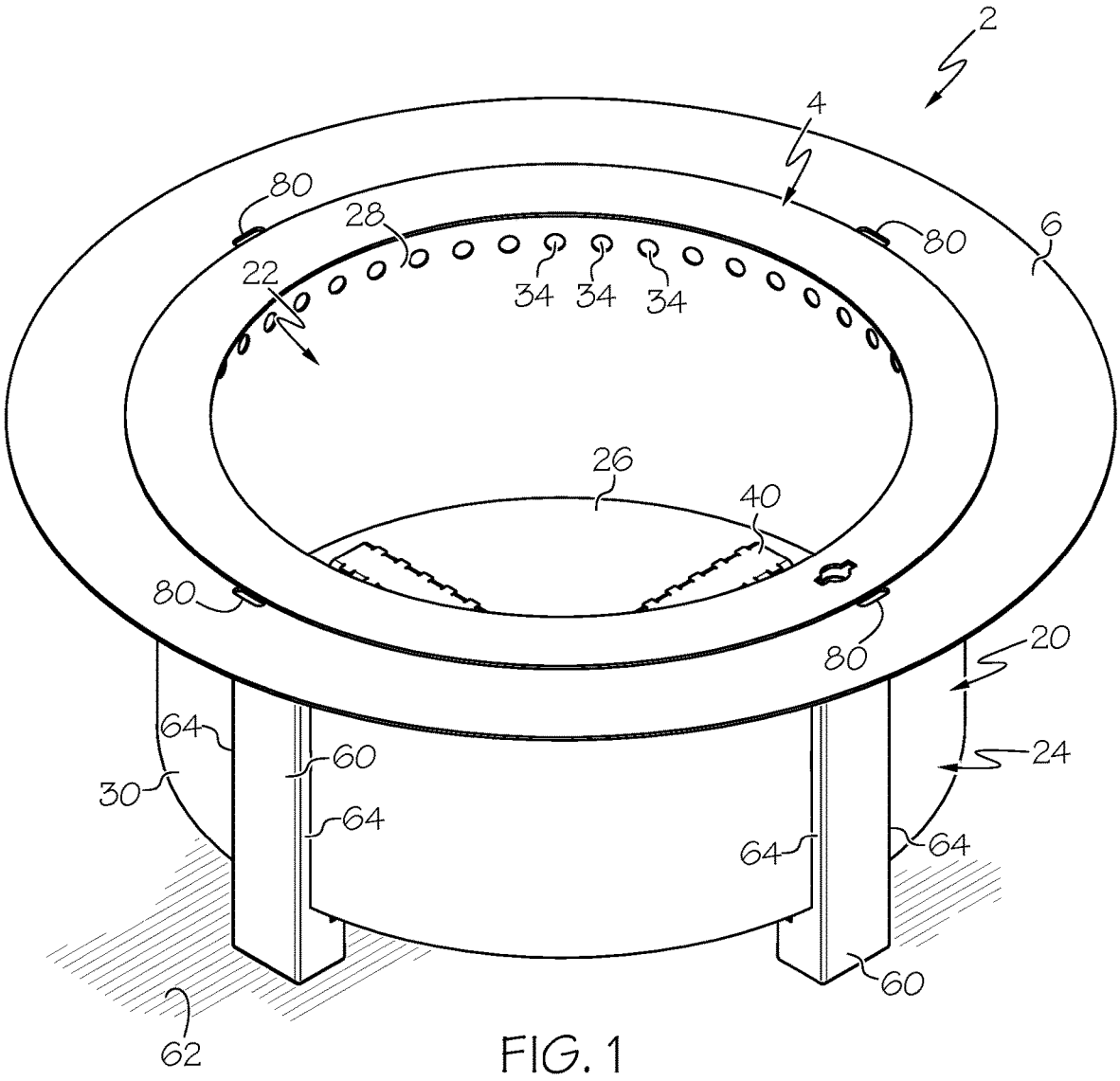
FIG. 1 is an upper perspective view of a fire pit with a conversion ring.
Figure 2:
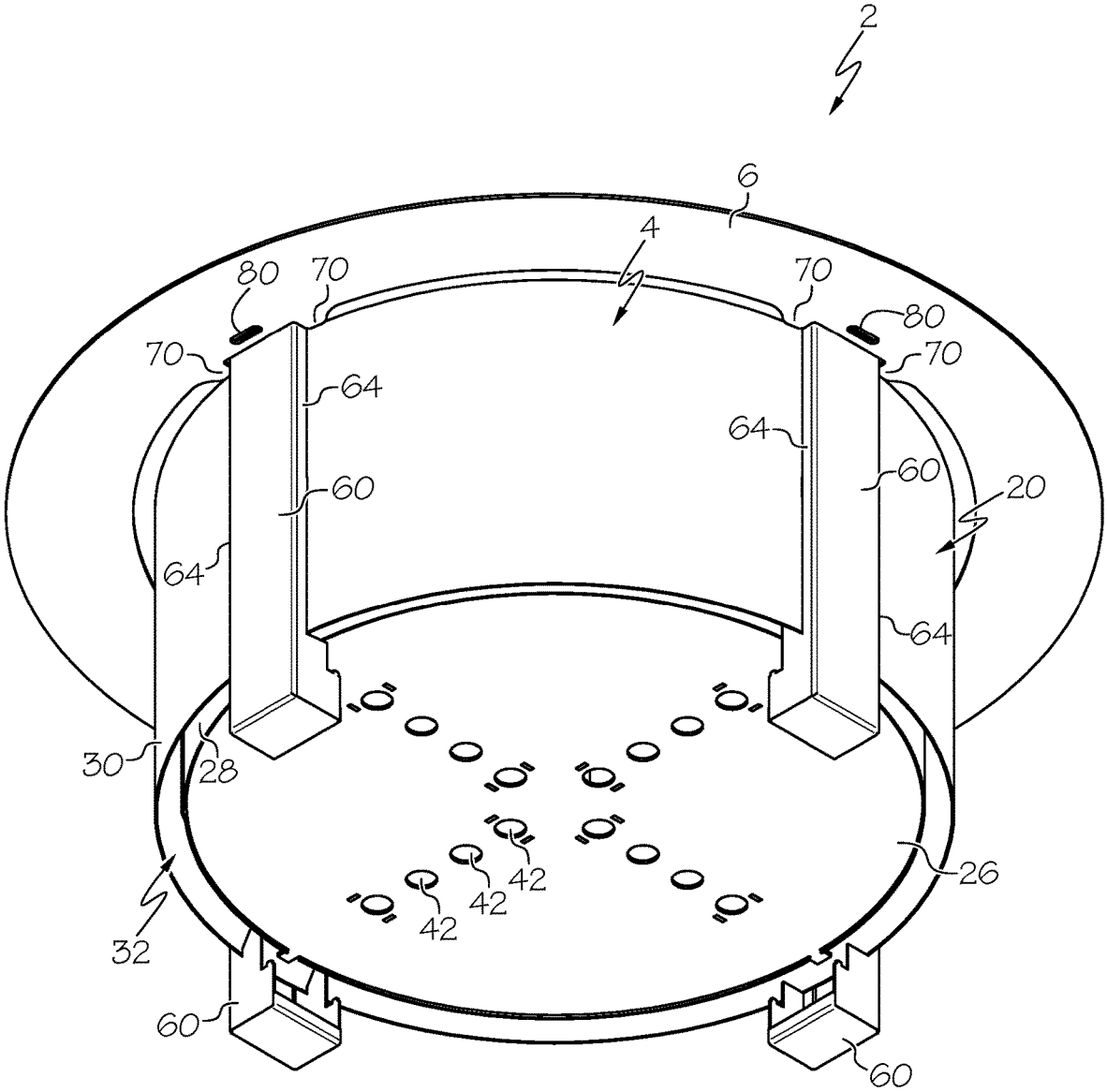
FIG. 2 is a lower perspective view of the fire pit and conversion ring.
Figure 3:
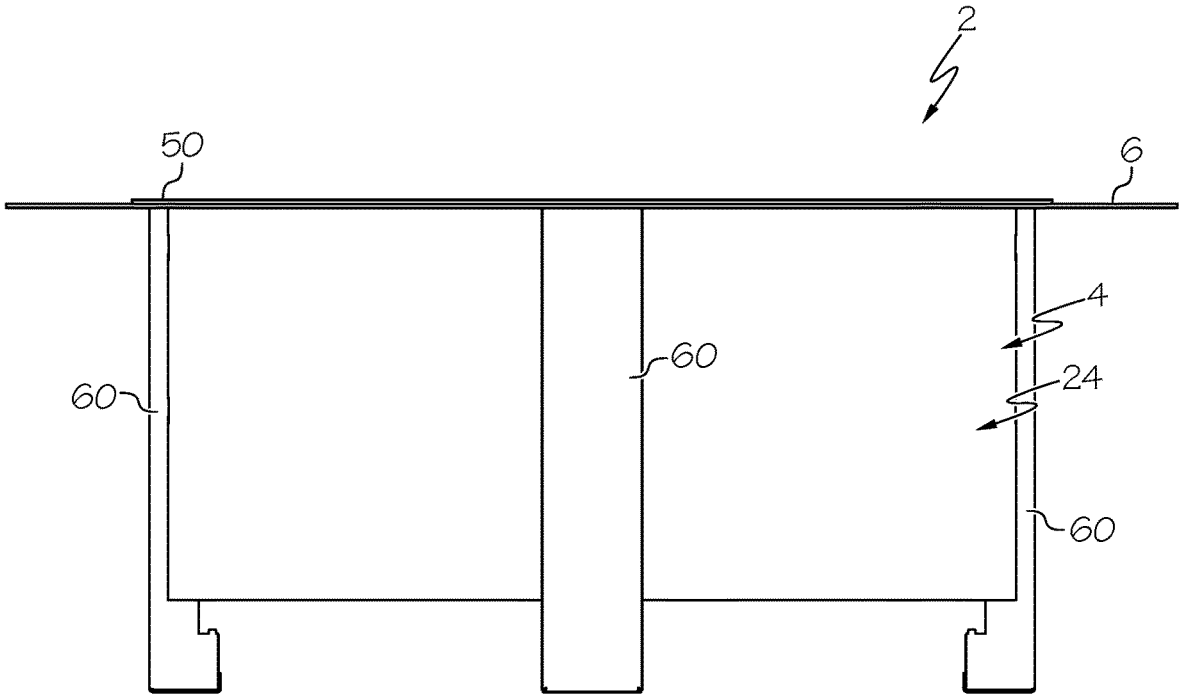
FIG. 3 is a front elevation view.
Figure 4:
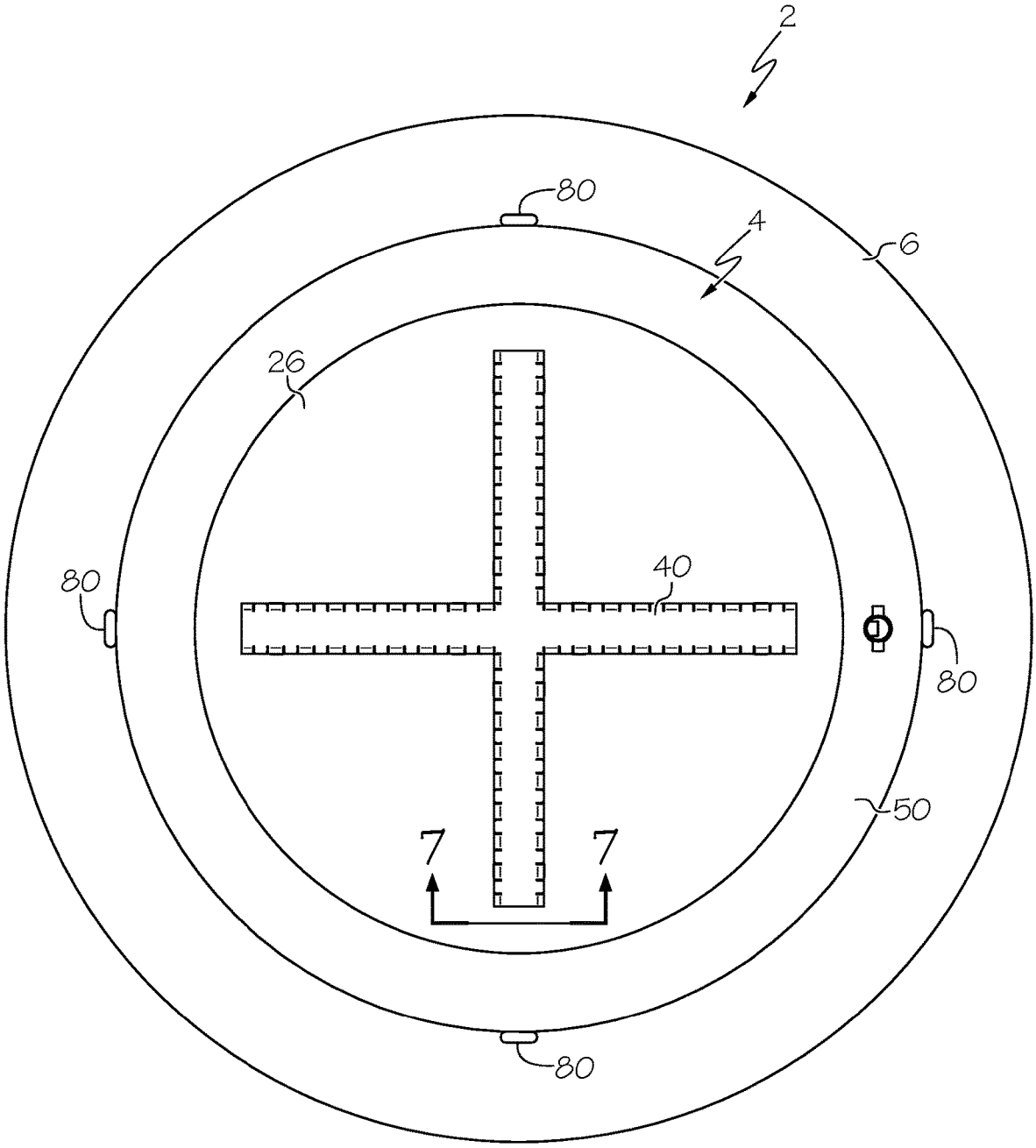
FIG. 4 is a top plan view.
Figure 5:
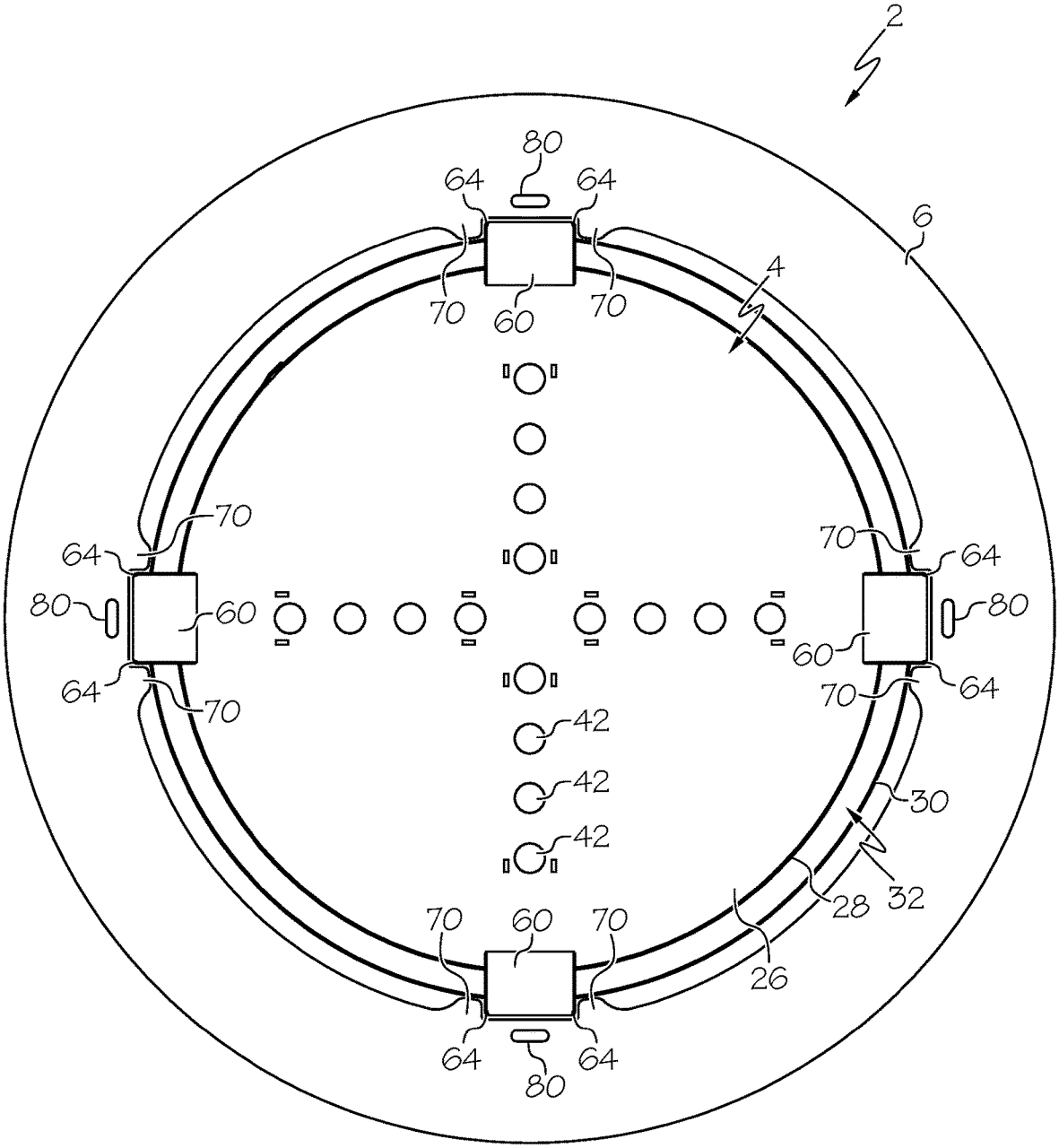
FIG. 5 is a bottom plan view.
Figure 6:
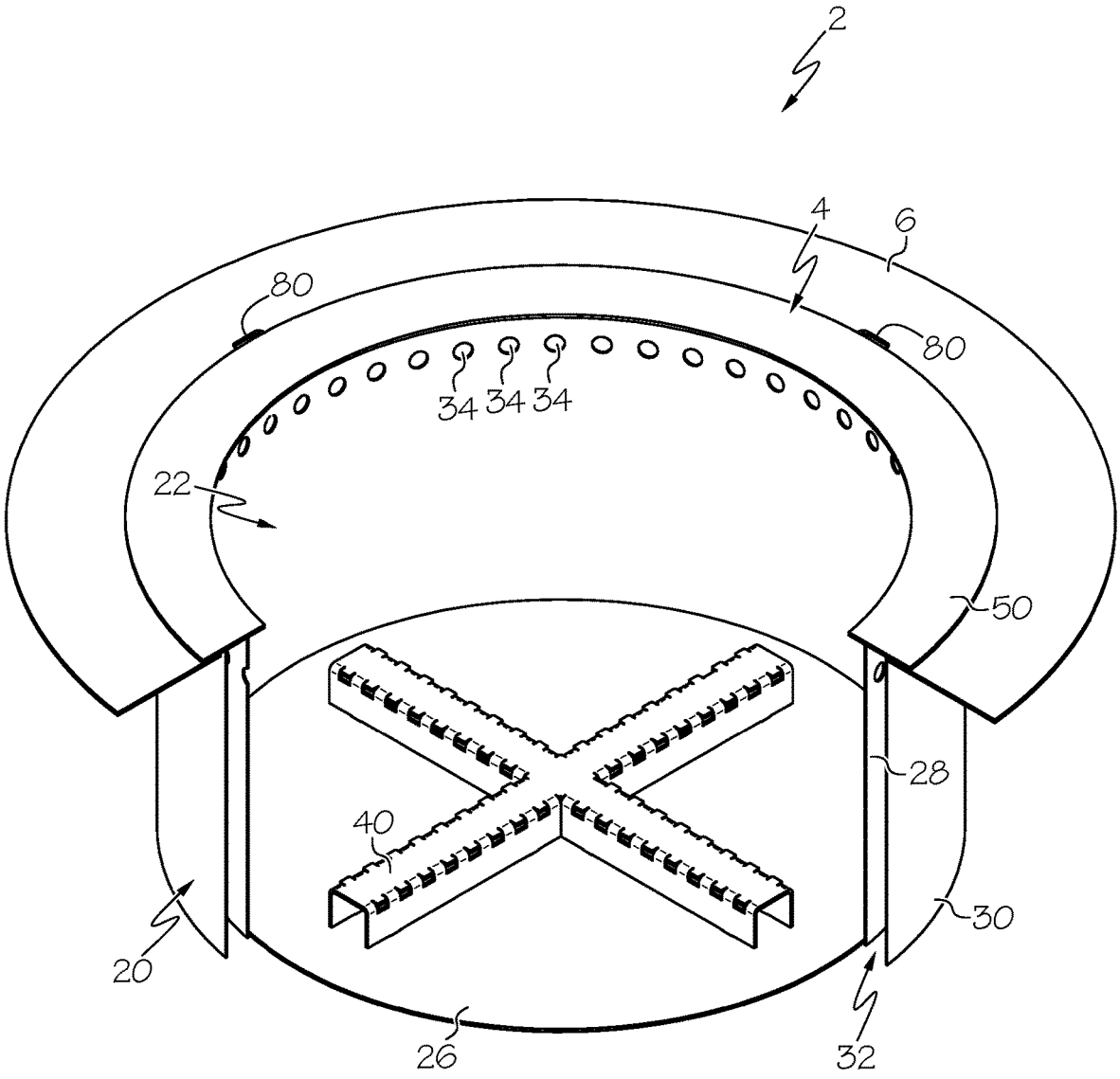
FIG. 6 is an upper perspective view with portions of the fire pit and conversion ring broken away to show the air inlet assembly.
Figure 7:
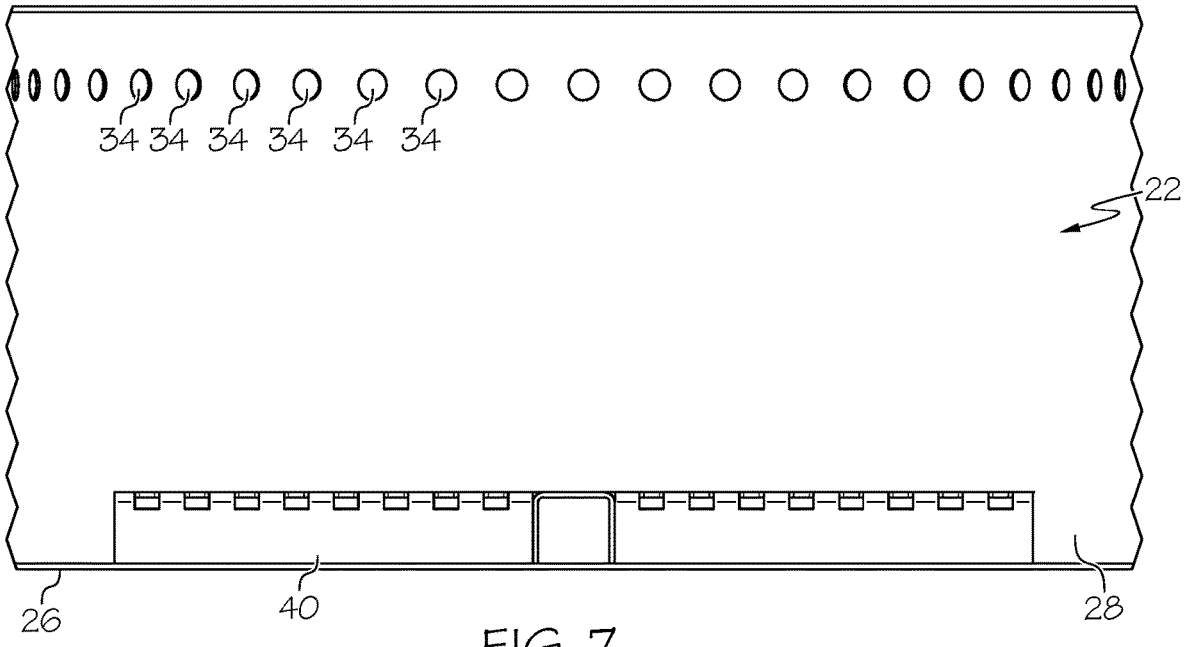
FIG. 7 is an elevation view of the air inlet assembly taken along line 7-7 of FIG. 4.

Portable fire pit 4 includes a plurality of legs 60 that support fire pit 4 on a support surface 62 with its bottom wall 26 and air inlet 32 above the support surface. In the exemplary configuration, each leg 60 extends down along sidewall 24 from under flange 50 to a location below bottom wall 26. Each leg 60 projects outwardly from sidewall 24 to define two shoulders 64. In this configuration, conversion ring 6 includes inwardly-projecting first and second locking fingers 70 for each leg 60. Each set of first and second locking fingers 70 cooperate with the inner edge of conversion ring 6 to define a channel sized to receive a leg 60. When a portion of leg 60 is disposed in this channel as shown in FIGS. 2 and 5, the locking fingers 70 are located against or close to shoulders 64 and relative rotation between conversion ring 6 and portable fire pit 4 is prevented. The inner edge of conversion ring 6 is spaced outwardly from outer sidewall 30. Air can be drawn in through these gaps. In some configurations, spacers can be located between the lower surface of flange 50 and the upper surface of conversion ring 6 to create an air gap that allows air to be drawn down outer sidewall 30 through the gap between conversion ring 6 and outer sidewall 30.

In other configurations, conversion ring 6 includes only a single locking finger 70 for at least two legs with fingers 70 engaging different sides of one or different legs to prevent the relative rotation. In another configuration wherein portable fire pit 4 has legs that do not define shoulders 64, the locking finger 70 or locking fingers 70 of conversion ring 6 are received in a recess or in recesses defined by portable fire pit 4. An example is vertical slots defined by sidewall 24 that receives locking fingers 70. In a further configuration, sidewall 24 includes outwardly-projecting protuberances or outwardly-projecting tabs (such as small sections of angle iron) that are engaged by locking fingers 70 to prevent the relative rotation.

Conversion ring 6 defines optional openings 80 that are used to receive projections from a lid 82 as shown in FIG. 9 to properly position lid 82 over the fire box and to prevent lid 82 from sliding off fire pit 4. When fire pit 4 is in use, openings 80 also function as air inlets to bring in air between outer sidewall 30 and the inner surface of block fire pit ring 8.

Conversion ring 6 allows an owner of a portable fire pit to use it with an outer fire pit ring such as block fire pit ring 8. This method includes the steps of placing conversion ring 6 on the outer fire pit ring and sliding the portable fire pit through conversion ring 6. The method also can be reordered to place conversion ring 6 on the portable fire pit and then installing the combination in the outer fire pit ring. For example, when an owner of portable fire pit 4 wants to use it in a block fire pit ring 8, the user obtains conversion ring 6 and places conversion ring 6 on block fire pit ring 8. The user then slides portable fire pit 4 down through conversion ring 6 and into block fire pit ring 8 until fire pit 4 is seated. It is seated when legs 60 engage surface 62 to support portable fire pit 4 or when the bottom of flange 50 engages the top of conversion ring 6. Portable fire pit 4 can then be used as it is designed within block fire pit ring 8.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A fire pit comprising:

a bottom wall and a sidewall that define a fire box; the fire box adapted to receive fuel that will be burned when the fire pit is used;

a plurality of legs; at least first portions of the legs being located lower than the bottom wall;

the fire box including a flange connected to the sidewall and extending outwardly of the sidewall;

a conversion ring disposed around the sidewall under the flange of the fire box; the conversion ring extending outwardly of the flange; the fire box can slide up and down with respect to the conversion ring;

the conversion ring including a set of first and second locking fingers for each of the legs; the first locking finger of each set being spaced from the second locking finger to define a channel;

a second portion of each leg defining first and second shoulders that define a width for the second portion of the leg; and the entire width of the second portion of each leg being located in the channel of one of the sets of first and second locking fingers with the first and second locking fingers located on the sides of the second portion of the leg with the first locking finger adjacent the first shoulder and the second locking finger adjacent the second shoulder.

2. The fire pit of claim 1, wherein second portions of the legs are located outwardly of the sidewall under the flange and wherein the flange extends farther from the sidewall than the second portions of the legs.

3. The fire pit of claim 1, wherein the conversion ring cannot rotate relative to the sidewall in a reference plane that contains the conversion ring.

4. The fire pit of claim 1, wherein the sidewall has an outer sidewall spaced from an inner sidewall to define an airflow passage; second portions of the legs being located outwardly of the outer sidewall under the flange and wherein the flange extends farther from the sidewall than the second portions of the legs.

5. A fire pit comprising:

a bottom wall and a sidewall that define a fire box; the fire box adapted to receive fuel that will be burned when the fire pit is used;

a plurality of legs; at least first portions of the legs being located lower than the bottom wall;

the fire box including a flange connected to the sidewall and extending outwardly of the sidewall;

a conversion ring disposed around the sidewall under the flange of the fire box; the conversion ring extending outwardly of the flange;

the conversion ring being disposed in a first reference plane substantially perpendicular to the sidewall;

wherein second portions of the legs are located outwardly of the sidewall under the flange;

the conversion ring including locking fingers engaging with at least one of the second portions of the legs to prevent the conversion ring from rotating with respect to the fire box; and the locking fingers extending inwardly from an inner edge of the conversion ring toward the sidewall.

6. The fire pit of claim 5, wherein the sidewall has an outer sidewall spaced from an inner sidewall to define an airflow passage.

7. A fire pit comprising:

a bottom wall and a sidewall that define a fire box; the fire box adapted to receive fuel that will be burned when the fire pit is used;

a plurality of legs; at least first portions of the legs being located lower than the bottom wall;

the fire box including a flange connected to the sidewall and extending outwardly of the sidewall;

a conversion ring disposed around the sidewall under the flange of the fire box; the conversion ring extending outwardly of the flange;

the conversion ring being disposed in a first reference plane substantially perpendicular to the sidewall;

the conversion ring including first and second locking fingers; a portion of a leg disposed between the first and second locking fingers to prevent the conversion ring from rotating with respect to the fire box; and the first and second locking fingers extending inwardly from an inner edge of the conversion ring toward the sidewall; the first and second locking fingers being parallel to the first reference plane.

8. The fire pit of claim 7, wherein the sidewall has an outer sidewall spaced from an inner sidewall to define an airflow passage.

9. The fire pit of claim 7, wherein the conversion ring includes a set of first and second locking fingers for each of the legs; each set receiving one leg.

* * * * *